US010299635B2

(12) United States Patent
Liu

(10) Patent No.: US 10,299,635 B2
(45) Date of Patent: May 28, 2019

(54) PRE-FORMED SHOWER PAN SYSTEMS AND METHODS

(71) Applicant: Zhongri Liu, San Jose, CA (US)

(72) Inventor: Zhongri Liu, San Jose, CA (US)

( * ) Notice: Subject to any disclaimer, the term of this patent is extended or adjusted under 35 U.S.C. 154(b) by 0 days.

(21) Appl. No.: 15/726,379

(22) Filed: Oct. 5, 2017

(65) Prior Publication Data

US 2019/0104892 A1 Apr. 11, 2019

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/613
See application file for complete search history.

(56) References Cited

U.S. PATENT DOCUMENTS

| | | | | |
|---|---|---|---|---|
| 5,140,789 | A * | 8/1992 | De Gooyer | A47K 3/40 4/613 |
| 2006/0213006 | A1* | 9/2006 | Rush, Jr. | A47K 3/40 4/613 |
| 2011/0197354 | A1* | 8/2011 | Wedi | A47K 3/40 4/613 |
| 2015/0128340 | A1* | 5/2015 | Davis, Jr. | A47K 3/40 4/613 |
| 2018/0110379 | A1* | 4/2018 | Wadaga | A47K 3/40 4/613 |

* cited by examiner

*Primary Examiner* — Tuan N Nguyen
(74) *Attorney, Agent, or Firm* — Tran & Associates

(57) ABSTRACT

A shower pan has a first portion having a drain hole and a bottom flat surface to contact a floor and a top surface having a predetermined slope toward the drain hole; and a second portion coupled to the first portion at the drain hole, the second portion having a bottom surface with the predetermined slope and adapted to gaplessly fit with the first portion through a waterproofing pan liner.

20 Claims, 18 Drawing Sheets

PRE-FORMED SHOWER PAN SYSTEMS AND METHODS

BACKGROUND

The present invention relates to a pre-formed shower pan with two portions.

A bathroom is a room in the home for personal hygiene activities, generally containing a sink (basin) and either a bathtub, a shower, or both. The shower facility is typically built by forming a wood or concrete subfloor. The subfloor has an opening for a drain pipe which is secured by a locking ring. Then a first layer of concrete is poured that is angled toward the drain hole. A shower pan liner is placed above the first layer of concrete to provide water proofing. Bolts are used to hold down the liner and to secure the drain to the drain pipe. A second layer of concrete is deposited above the liner. Tiles are then placed above the second layer of concrete. Then the wall support structure is formed, and glass is typically used as one or more walls of the shower. A door allows the user to access the shower. The conventional mortar/concrete is labor intensive in that it requires careful checking of the concrete pouring to ensure an even and balanced slope is formed toward the drain pipe.

SUMMARY

In one aspect, a shower pan has a first portion having a drain hole and a bottom flat surface to contact a floor and a top surface having a predetermined slope toward the drain hole; and a second portion coupled to the first portion at the drain hole, the second portion having a bottom surface with the predetermined slope and adapted to gaplessly fit with the first portion through a waterproofing pan liner.

In another aspect, a method for building a shower includes forming a shower subfloor with a flat surface; placing a first preformed pan module with a first flat surface facing the subfloor flat surface, the first preformed pan module having a first sloped surface toward a drain hole; placing a second preformed pan module above the first preformed pan module with a shower pan liner in between for waterproofing, the second preformed module having a first surface to engage the first sloped surface with the liner and an upper sloped surface; and installing tiles on the upper sloped surface of the second preformed pan module.

Implementations of the above aspects may include one or more of the following. The bottom surface of the "bottom" piece is flat surface, which can goes directly on subfloor of building. The top surface of this "bottom" piece is sloped by ¼" or more per foot running towards to the drain hole (the round hole on the piece, which can be either centered or off centered). All the edges of the top surface are straight line and parallel with the bottom edges.

The bottom of the "top" piece is a smooth sloped which is just fit the top of the "bottom" piece. When put two pieces together, there is no gap in between. The top of "top" piece is smooth sloped to the drain which could be either upside down cone shape or a tilted flat surface.

When installed, the two pieces provide a pre-formed custom shower base. The waterproofing of the base is provided by a waterproof material which will be "sandwiched" by top and bottom piece. The pieces can form various shapes including rectangular, square, sector and quadrangle.

Advantages of the system may include one or more of the following. The shower base enables showers to be built with fewer defects. Aesthetic and functional innovations can be added to improve the quality of the shower base. Using shower base lowers construction costs by reducing construction time, improving quality, and eliminating the bathroom defects list. With traditional building, a multitude of trades need to be organized to realize the bathroom design. This requires a high degree of supervision and management on site to ensure correct sequencing and quality of work from plumbers, electricians, tilers, floor layers, sealant applicators, decorators, glaziers, carpenters, and other specialists. Pre-fabricated shower pans or bases eliminate defects, save time and money over hand pouring of concrete mortars above the subfloor, and the savings from waste and improved quality result in less snagging and better performance in use. More significantly, reduced construction times mean earlier income streams from the project. Pre-fabricated bases are less wasteful than traditional forms of construction and thus more sustainable. Factory waste material is typically less than 1.5% compared with 7%+ on a traditional construction site and recycling of waste is more reliably controlled in a factory environment than it is on-site.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 3 shows a top view of the pan of FIG. 1, while

FIG. 5 shows a front/back view of the pan of FIG. 1, while

FIG. 9 shows a top view of the pan of FIG. 7, while

FIG. 11 shows a front/back view of the pan of FIG. 7, while

FIG. 15 shows a top view of the pan of FIG. 13, while

FIG. 17 shows a front/back view of the pan of FIG. 13, while

FIG. 21 shows a top view of the pan of FIG. 19, while

FIG. 23 shows a front/back view of the pan of FIG. 19, while

FIG. 27 shows a top view of the pan of FIG. 25, while

FIG. 35 shows a top view of the pan of FIG. 33, while

FIG. 43 shows a top view of the pan of FIG. 41, while

FIG. 45 shows a front/back view of the pan of FIG. 41, while

FIG. 49 shows a top view of the pan of FIG. 47, while

FIG. 51 shows a front/back view of the pan of FIG. 47, while

FIG. 54 shows a lengthwise cross-sectional view of FIG. 53 while

FIG. 56 shows a top of the pan of FIG. 53, while

FIG. 58 shows a front/back view of the pan of FIG. 53, while

FIG. 60 shows exemplary perspective view of FIGS. 1-12, while

FIG. 62 shows exemplary perspective view of FIGS. 13-24, while

FIG. 64 shows exemplary perspective view of FIGS. 25-40, while

FIG. 66 shows exemplary perspective view of FIGS. 41-52, while

DESCRIPTION

Figure 1:
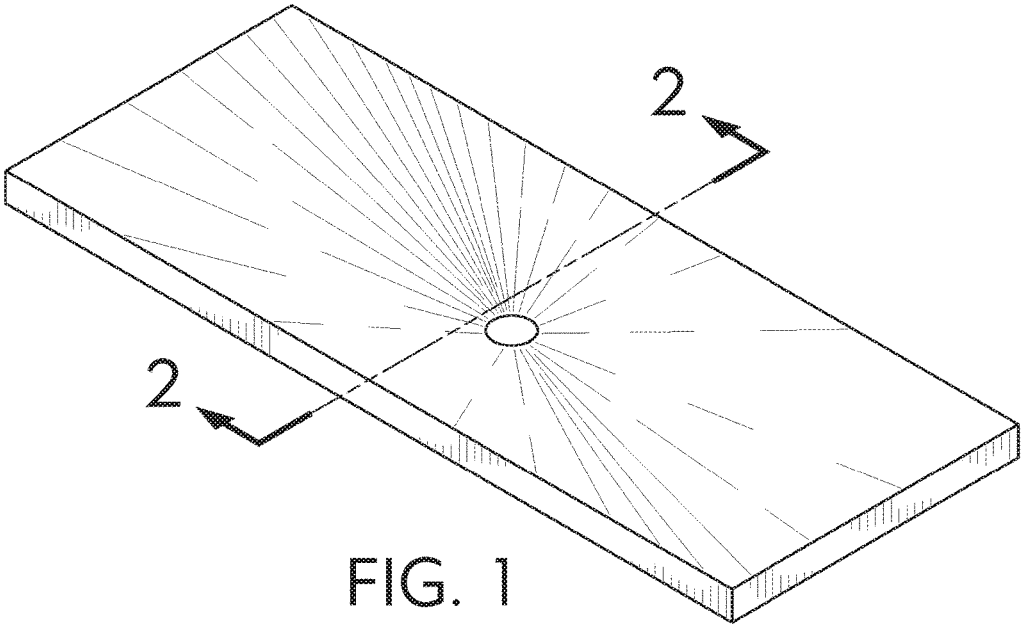
FIG. 1 shows a perspective view of a first embodiment of a floor pan.
Figure 2:
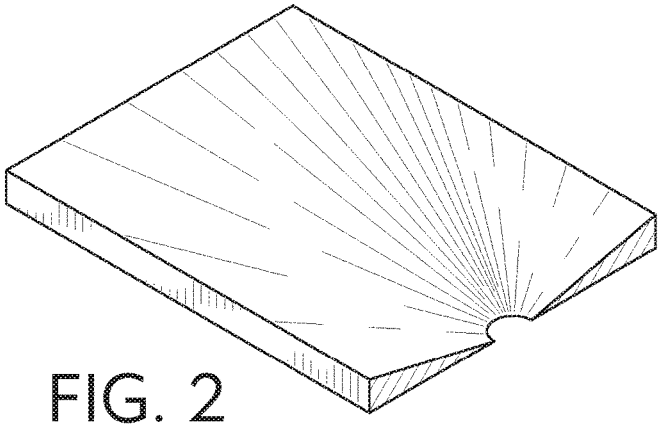
FIG. 2 shows a cross-sectional view of FIG. 1.
Figure 3:
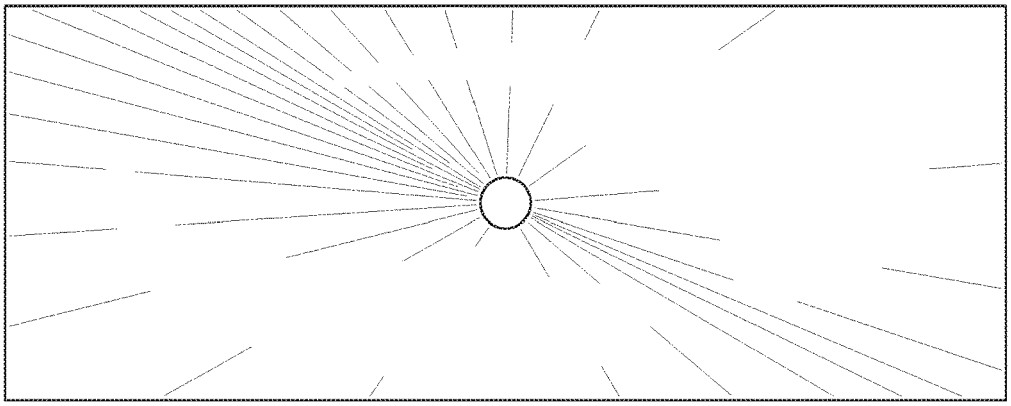
Figure 4:
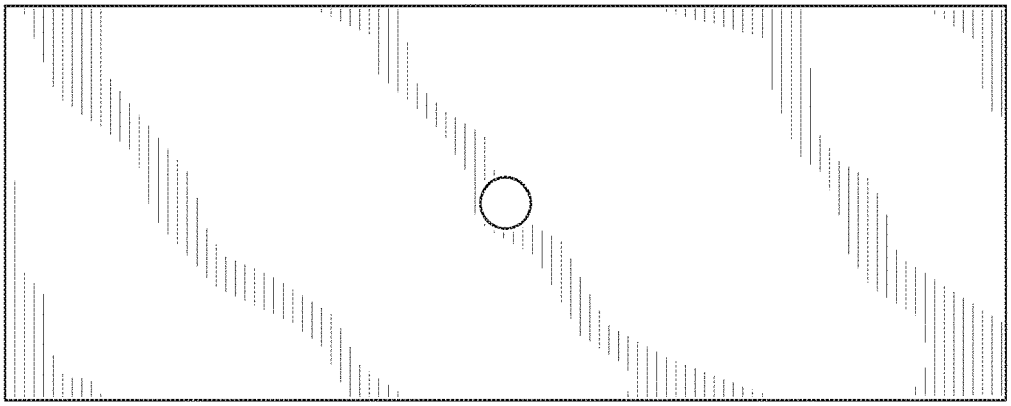
FIG. 4 shows a bottom view of the pan of FIG. 1.
Figure 5:
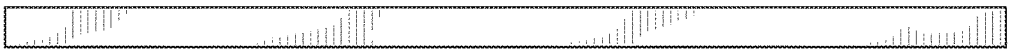
Figure 6:
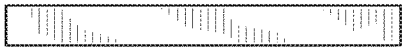
FIG. 6 shows a side view of the pan.

Referring to the drawings, FIG. 1 shows a perspective view of a first embodiment of a floor pan. The combined first and second portions have a flat bottom to contact the building floor, and sloped surface from the four corners to a drain hole. FIG. 2 shows a cross-sectional view of FIG. 1. FIG. 3 shows a top view of the pan of FIG. 1, while FIG. 4 shows a bottom view of the pan of FIG. 1. FIG. 5 shows a front/back view of the pan of FIG. 1, while FIG. 6 shows a side view of the pan.

The floor pan is formed by securing a top (or second) portion and a bottom (or first) portion and separated by a waterproof material. The pan is thus formed by two pieces, one on the top and one at the bottom, separated by a waterproof material.

The bottom surface of the "bottom" piece is flat surface, which can go directly on subfloor of building. The top surface of this "bottom" piece is sloped by ¼" or more per foot running towards to the drain hole (the round hole on the piece, which can be either centered or off centered). All the edges of the top surface are straight line and parallel with the bottom edges.

The bottom of the "top" piece is a smooth sloped surface which is just fit the top of the "bottom" piece. When put two pieces together, there is no gap in between. The top of "top" piece is smooth sloped to the drain which could be either upside down cone shape or a tilted flat surface.

When installed, the two pieces provide a pre-formed custom shower base. The waterproofing of the base is provided by a waterproof material which will be "sandwiched" by top and bottom piece. The pieces can form various shapes including rectangular, square, sector and quadrangle, as shown in the various embodiments below.

The portions or pieces can be formed using various techniques. For example, the pan can be molded from any number of materials. However, in its preferred embodiment the pan is molded of sturdy plastic. Those skilled in the art will understand that there are numerous materials that can be utilized to mold the pan and numerous other methods for adjusting the size of the pan. The material and method disclosed herein are the preferred materials and methods respectively.

Figure 7:
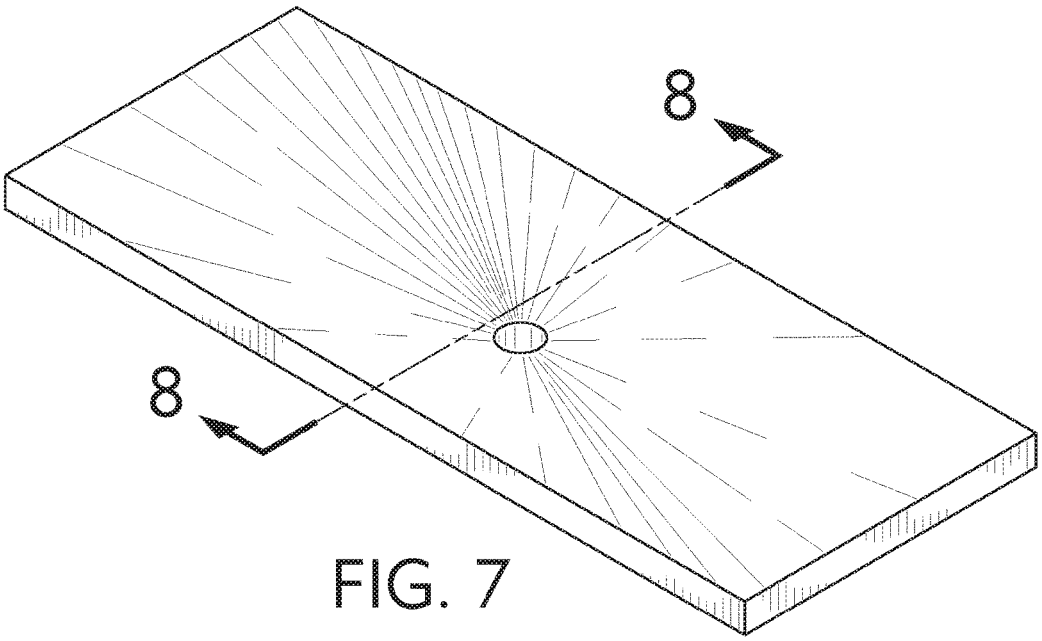
FIG. 7 shows a perspective view of a second embodiment of a floor pan.
Figure 8:
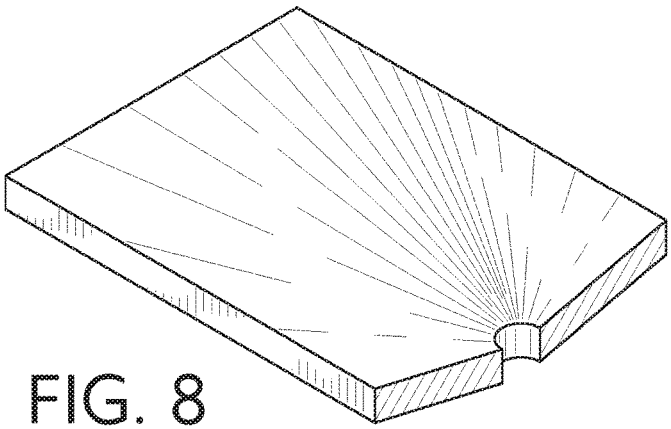
FIG. 8 shows a cross-sectional view of FIG. 7.
Figure 9:
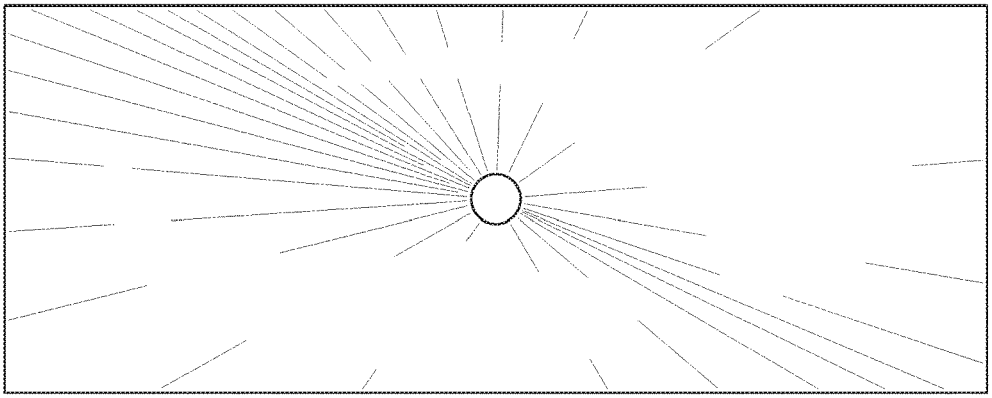
Figure 10:
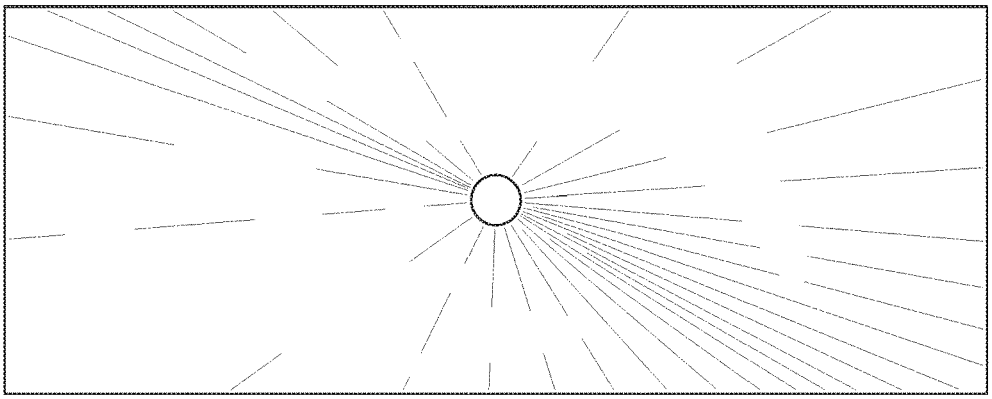
FIG. 10 shows a bottom view of the pan of FIG. 7.
Figure 11:
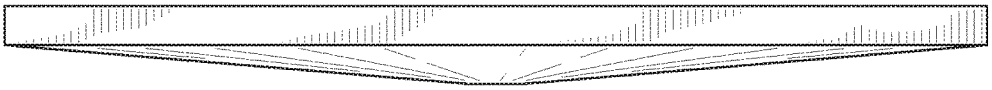
Figure 12:
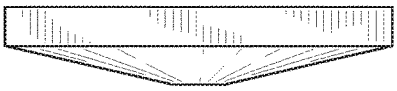
FIG. 12 shows a side view of the pan.

FIG. 7 shows a perspective view of a second embodiment of a floor pan which is square in shape. FIG. 8 shows a cross-sectional view of FIG. 7. FIG. 9 shows a top view of the pan of FIG. 7, while FIG. 10 shows a bottom view of the pan of FIG. 7. FIG. 11 shows a front/back view of the pan of FIG. 7, while FIG. 12 shows a side view of the pan.

Figure 13:
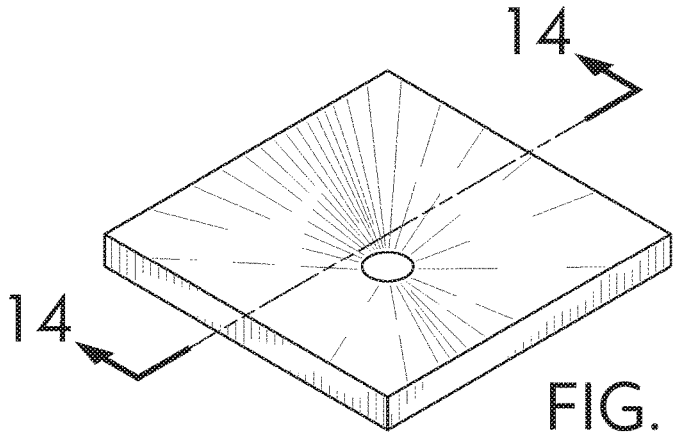
FIG. 13 shows a perspective view of a third embodiment of a floor pan.
Figure 14:
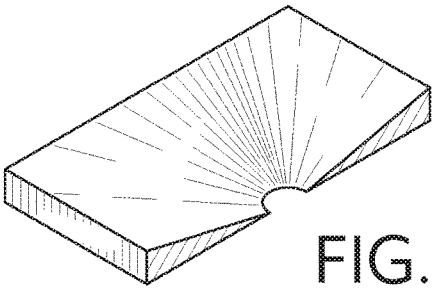
FIG. 14 shows a cross-sectional view of FIG. 13.
Figure 15:
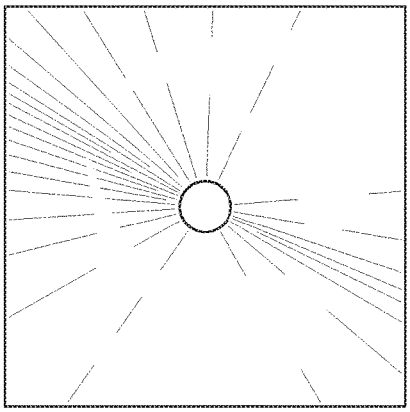
Figure 16:
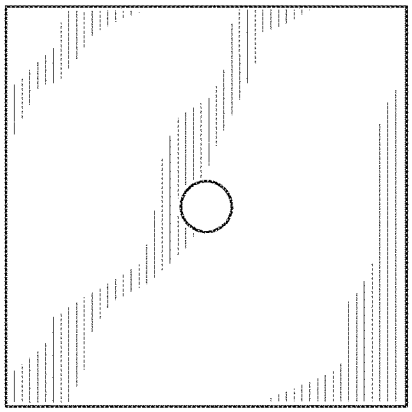
FIG. 16 shows a bottom view of the pan of FIG. 13.
Figure 17:
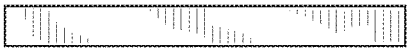
Figure 18:
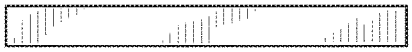
FIG. 18 shows a side view of the pan.

FIG. 13 shows a perspective view of a third embodiment of a floor pan with a corner cut. FIG. 14 shows a cross-sectional view of FIG. 13. FIG. 15 shows a top view of the pan of FIG. 13, while FIG. 16 shows a bottom view of the pan of FIG. 13. FIG. 17 shows a front/back view of the pan of FIG. 13, while FIG. 18 shows a side view of the pan.

Figure 19:
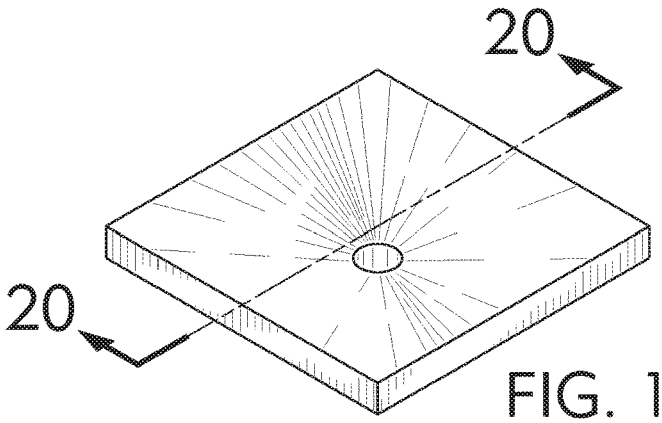
FIG. 19 shows a perspective view of a fourth embodiment of a floor pan.
Figure 20:
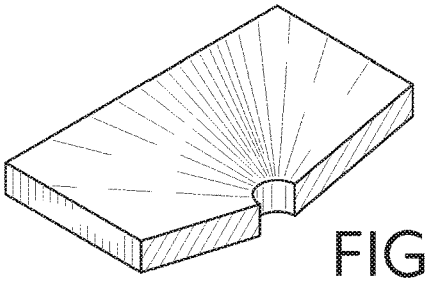
FIG. 20 shows a cross-sectional view of FIG. 19.
Figure 21:
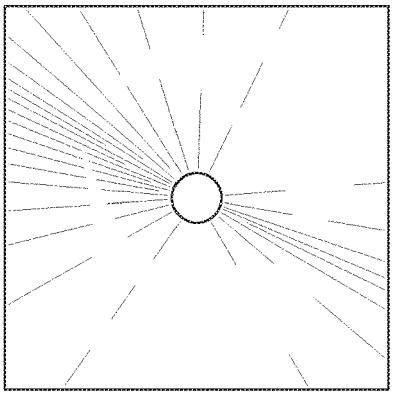
Figure 22:
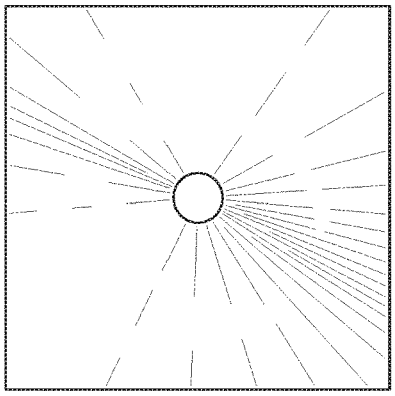
FIG. 22 shows a bottom view of the pan of FIG. 19.
Figure 23:
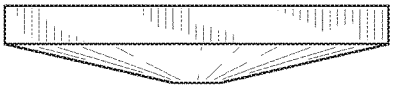
Figure 24:
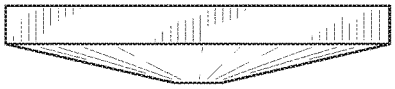
FIG. 24 shows a side view of the pan.

FIG. 19 shows a perspective view of a fourth embodiment of a floor pan. FIG. 20 shows a cross-sectional view of FIG. 19. FIG. 21 shows a top view of the pan of FIG. 19, while FIG. 22 shows a bottom view of the pan of FIG. 19. FIG. 23 shows a front/back view of the pan of FIG. 19, while FIG. 24 shows a side view of the pan.

Figure 25:
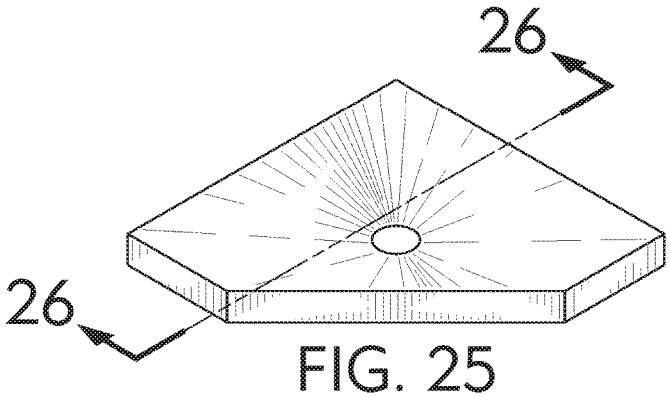
FIG. 25 shows a perspective view of a fifth embodiment of a floor pan.
Figure 26:
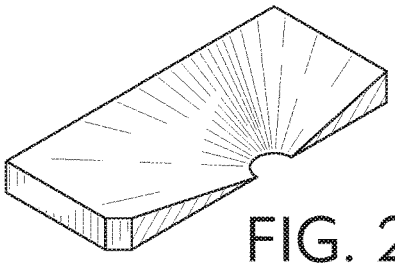
FIG. 26 shows a cross-sectional view of FIG. 25.
Figure 27:
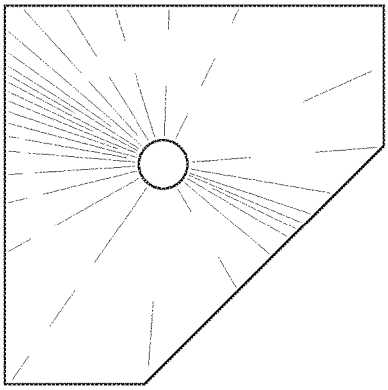
Figure 28:
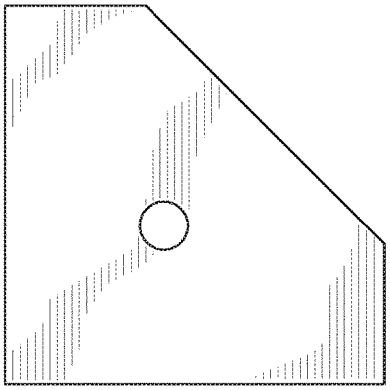
FIG. 28 shows a bottom view of the pan of FIG. 25.
Figure 29:
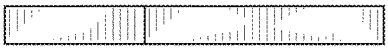
FIG. 29 shows a front view of the pan.
Figure 30:
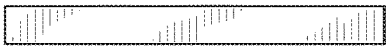
FIG. 30 shows a back view of the pan.
Figure 31:
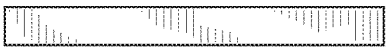
FIG. 31 shows a left-side view of the pan.
Figure 32:
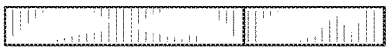
FIG. 32 shows a right-side view of the pan.

FIG. 25 shows a perspective view of a fifth embodiment of a floor pan. FIG. 26 shows a cross-sectional view of FIG. 25. FIG. 27 shows a top view of the pan of FIG. 25, while FIG. 28 shows a bottom view of the pan of FIG. 25. FIG. 29 shows a front view of the pan. FIG. 30 shows a back view of the pan. FIG. 31 shows a left-side view of the pan. FIG. 32 shows a right-side view of the pan.

Figure 33:
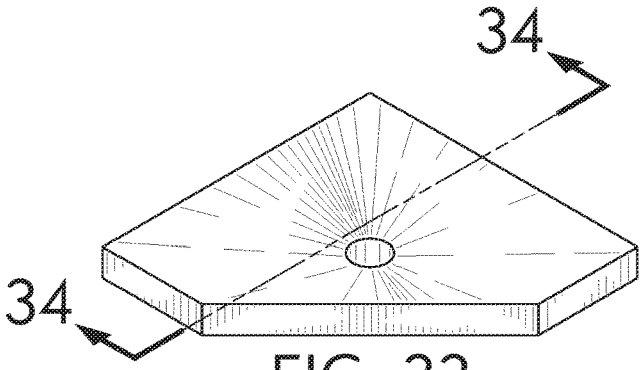
FIG. 33 shows a perspective view of a sixth embodiment of a floor pan.
Figure 34:
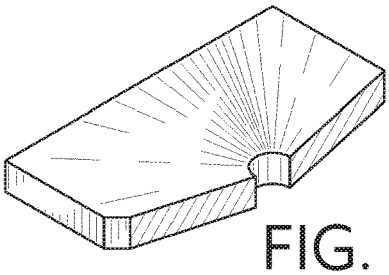
FIG. 34 shows a cross-sectional view of FIG. 33.
Figure 35:
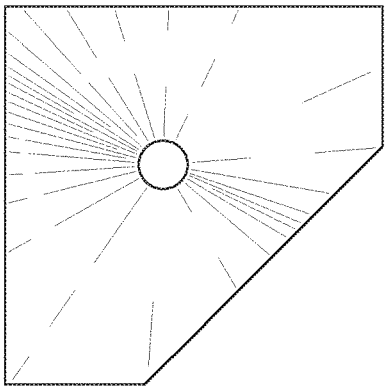
Figure 36:
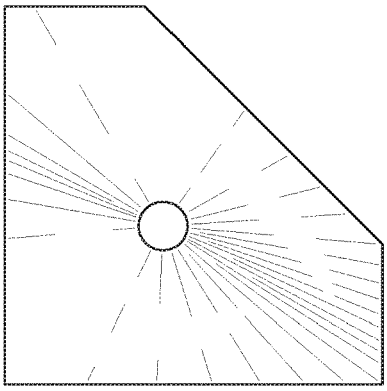
FIG. 36 shows a bottom view of the pan of FIG. 33.
Figure 37:
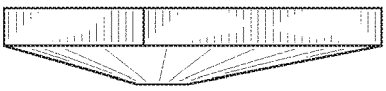
FIG. 37 shows a front view of the pan.
Figure 38:
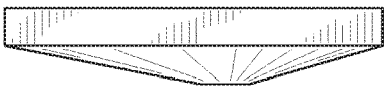
FIG. 38 shows a back view of the pan.
Figure 39:
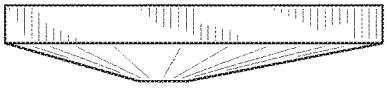
FIG. 39 shows a left-side view of the pan.
Figure 40:
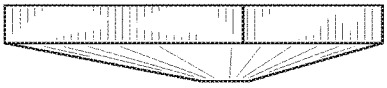
FIG. 40 shows a right-side view of the pan.

FIG. 33 shows a perspective view of a sixth embodiment of a floor pan. FIG. 34 shows a cross-sectional view of FIG. 33. FIG. 35 shows a top view of the pan of FIG. 33, while FIG. 36 shows a bottom view of the pan of FIG. 33. FIG. 37 shows a front view of the pan. FIG. 38 shows a back view of the pan. FIG. 39 shows a left-side view of the pan. FIG. 40 shows a right-side view of the pan.

Figure 41:
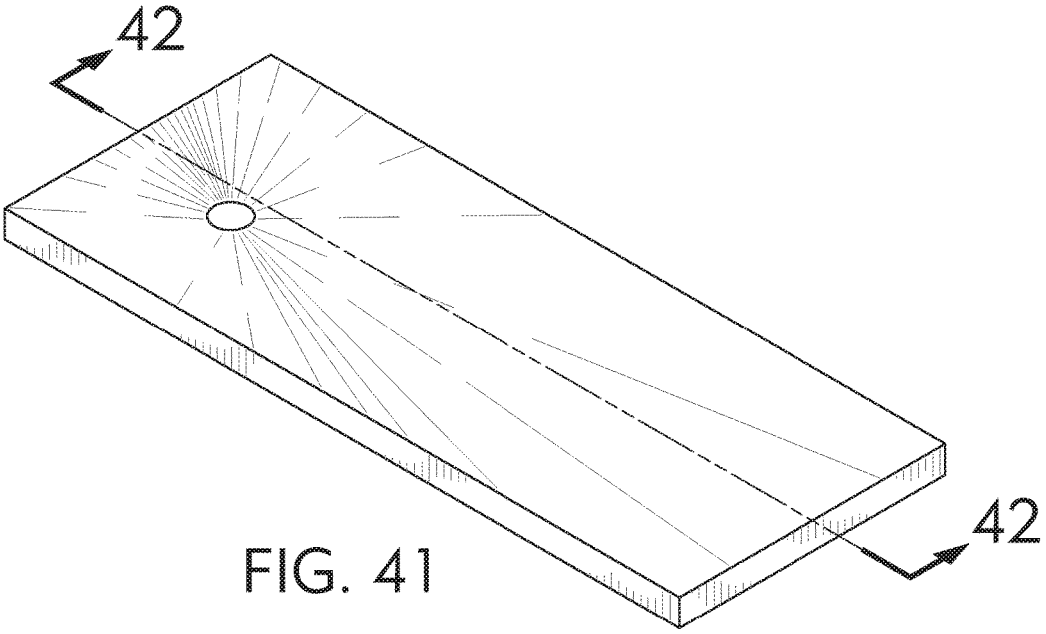
FIG. 41 shows a perspective view of a seventh embodiment of a floor pan.
Figure 42:
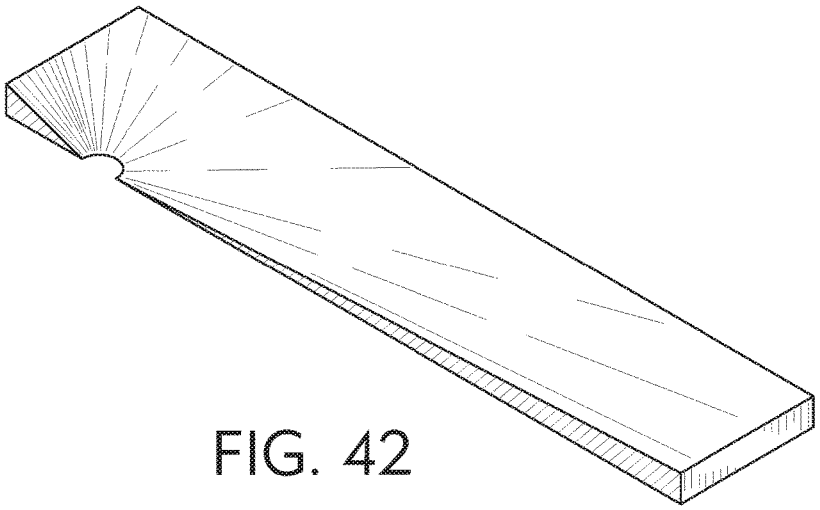
FIG. 42 shows a cross-sectional view of FIG. 41.
Figure 43:
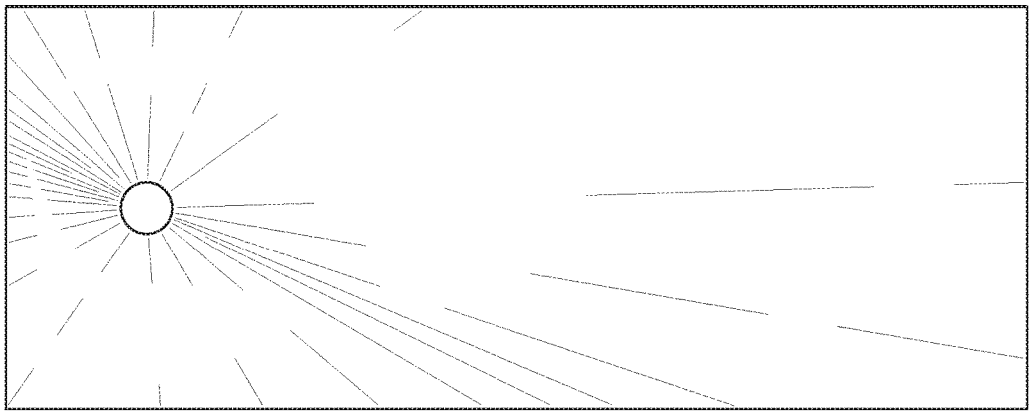
Figure 44:
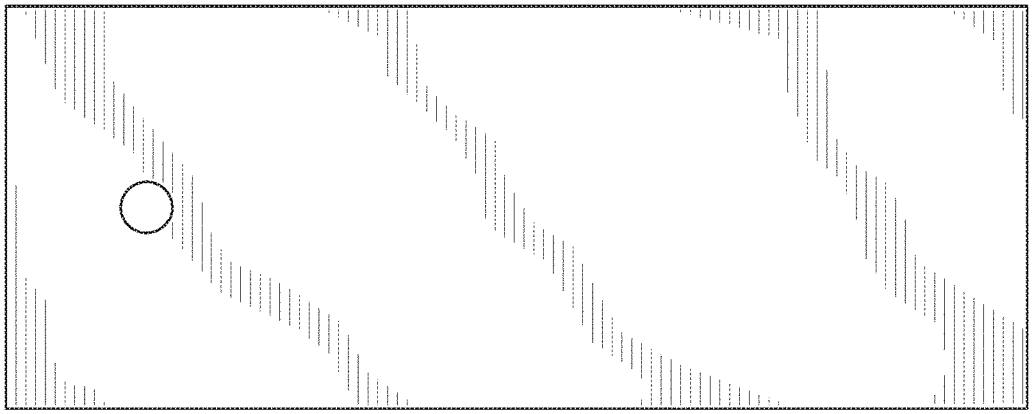
FIG. 44 shows a bottom view of the pan of FIG. 41.
Figure 45:
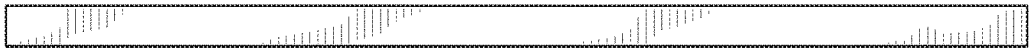
Figure 46:
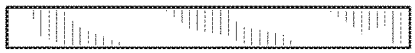
FIG. 46 shows a side view of the pan.

FIG. 41 shows a perspective view of a seventh embodiment of a floor pan. FIG. 42 shows a cross-sectional view of FIG. 41. FIG. 43 shows a top view of the pan of FIG. 41, while FIG. 44 shows a bottom view of the pan of FIG. 41. FIG. 45 shows a front/back view of the pan of FIG. 41, while FIG. 46 shows a side view of the pan.

Figure 47:
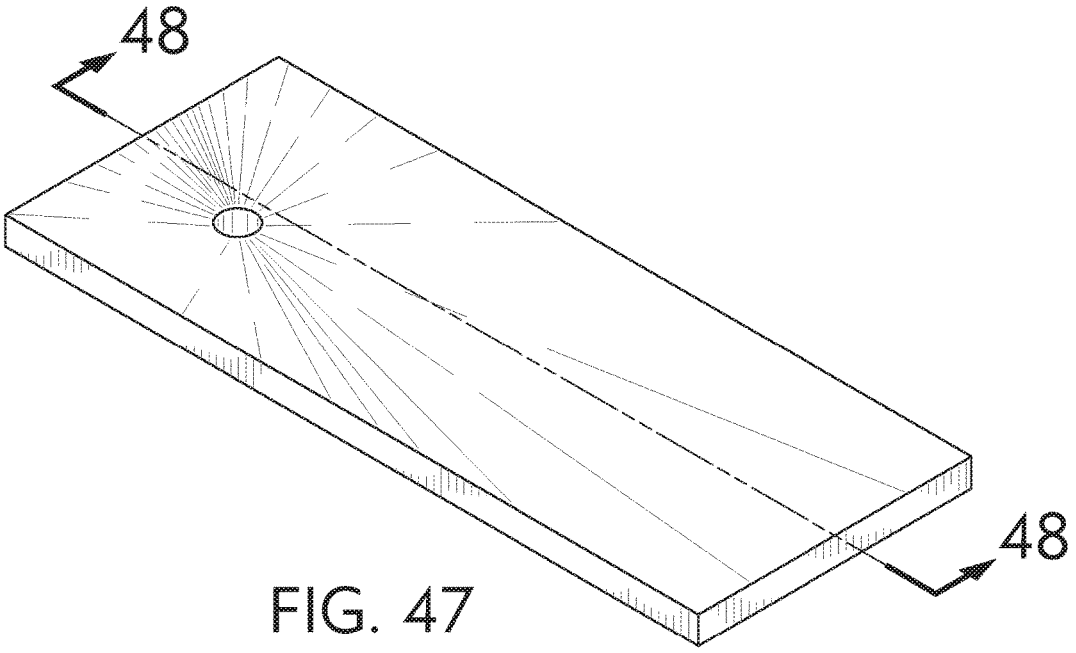
FIG. 47 shows a perspective view of an eight embodiment of a floor pan.
Figure 48:
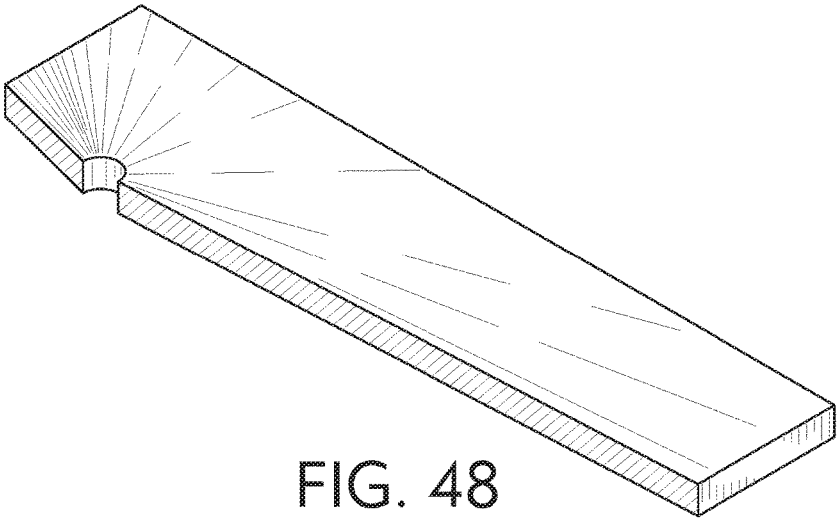
FIG. 48 shows a cross-sectional view of FIG. 47.
Figure 49:
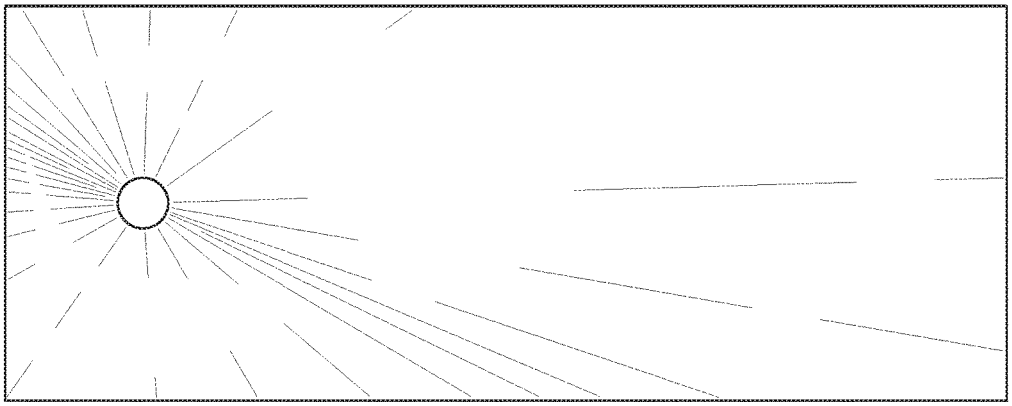
Figure 50:
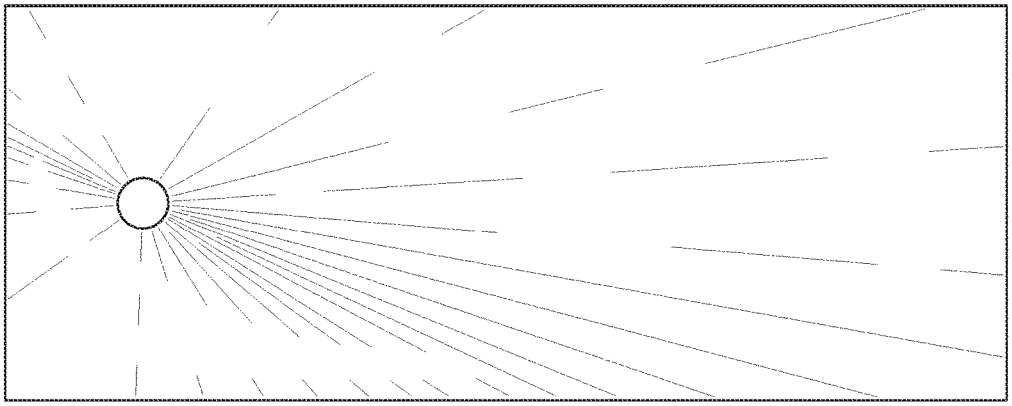
FIG. 50 shows a bottom view of the pan of FIG. 47.
Figure 51:
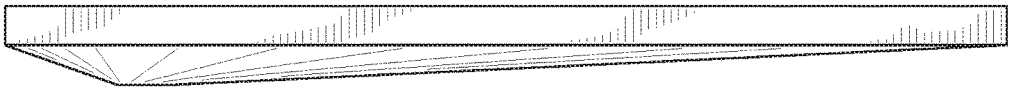
Figure 52:
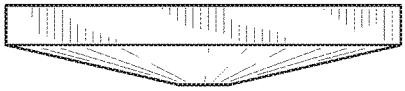
FIG. 52 shows a side view of the pan.

FIG. 47 shows a perspective view of an eight embodiment of a floor pan. FIG. 48 shows a cross-sectional view of FIG. 47. FIG. 49 shows a top view of the pan of FIG. 47, while FIG. 50 shows a bottom view of the pan of FIG. 47. FIG. 51 shows a front/back view of the pan of FIG. 47, while FIG. 52 shows a side view of the pan.

Figure 53:
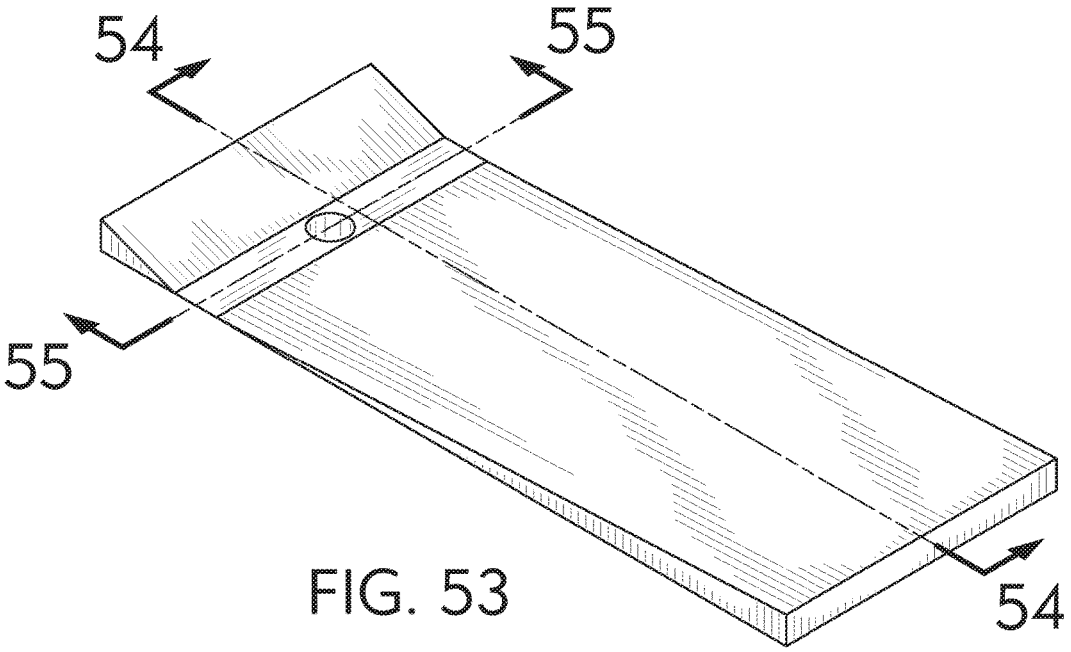
FIG. 53 shows a perspective view of a ninth embodiment of a floor pan.
Figure 54:
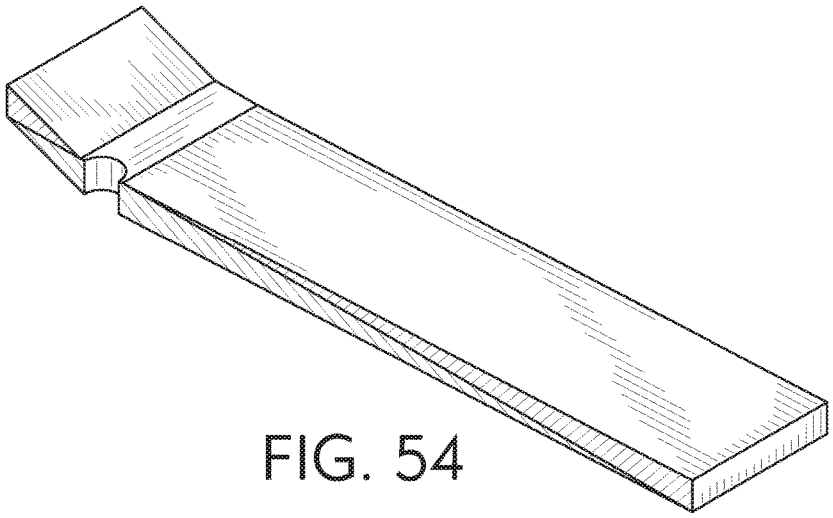
Figure 55:
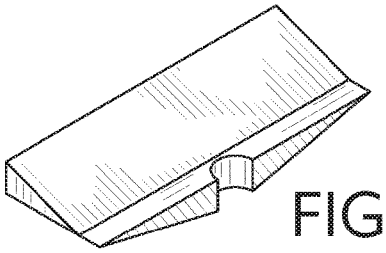
FIG. 55 shows a width-wise cross-sectional view of FIG. 53.
Figure 56:
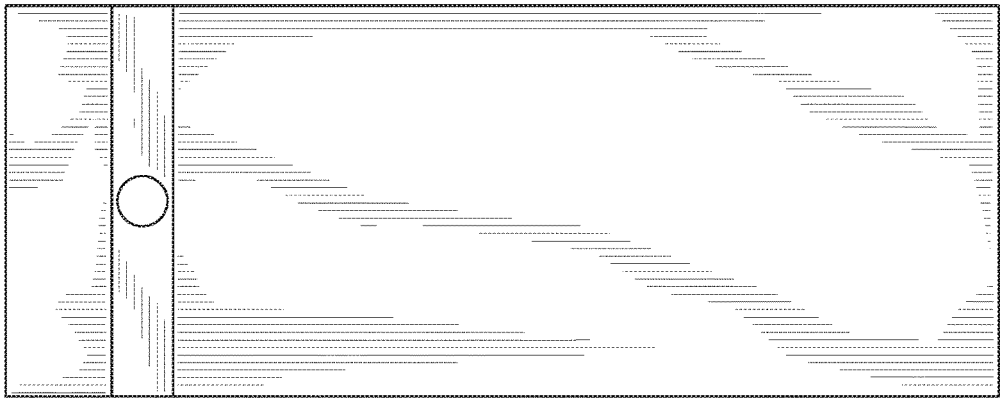
Figure 57:
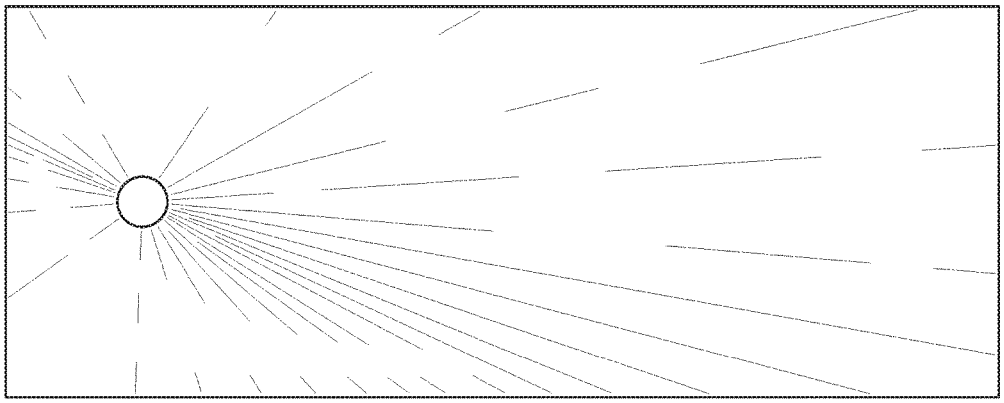
FIG. 57 shows a bottom view of the pan of FIG. 53.
Figure 58:
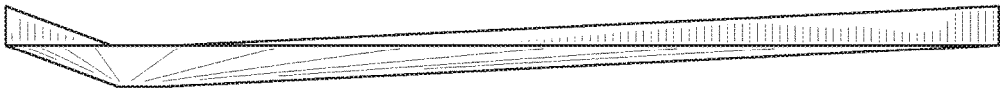
Figure 59:
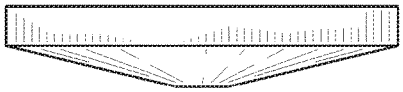
FIG. 59 shows a side view of the pan.
Figure 60:
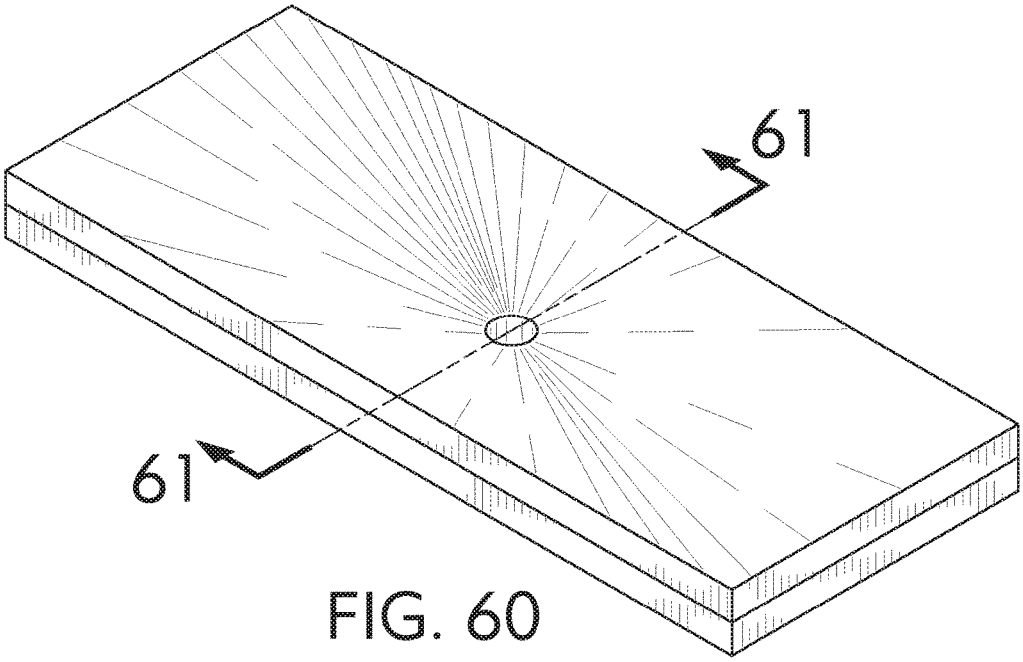
Figure 61:
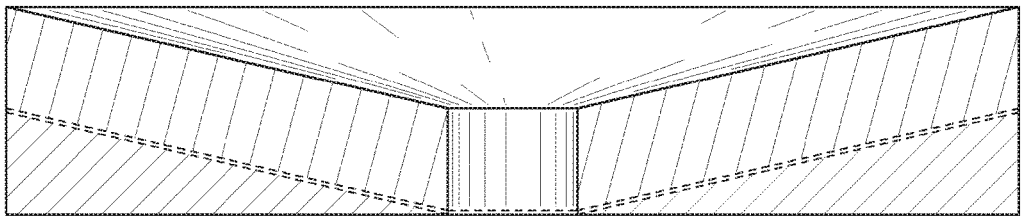
FIG. 61 shows a cross-sectional view of FIG. 60, where a waterproofing liner shown as dashed lines is disclaimed from the design.
Figure 62:
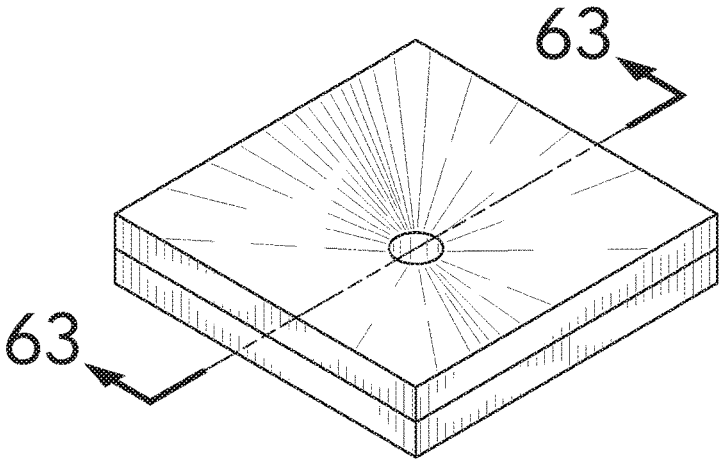
Figure 63:
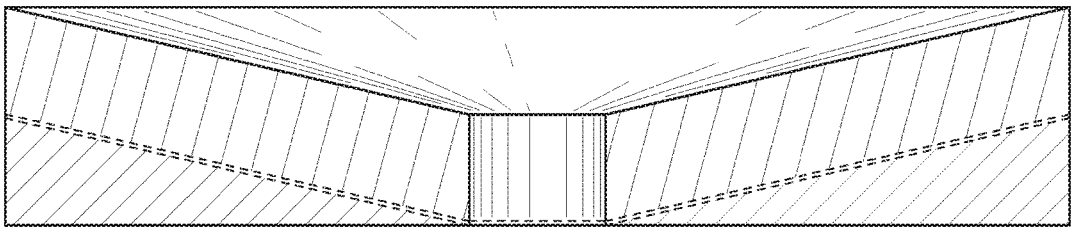
FIG. 63 shows a cross-sectional view of FIG. 62, where a waterproofing liner shown as dashed lines is disclaimed from the design.
Figure 64:
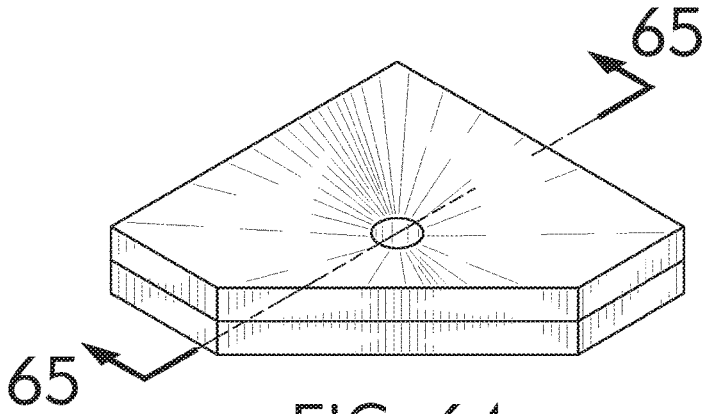
Figure 65:
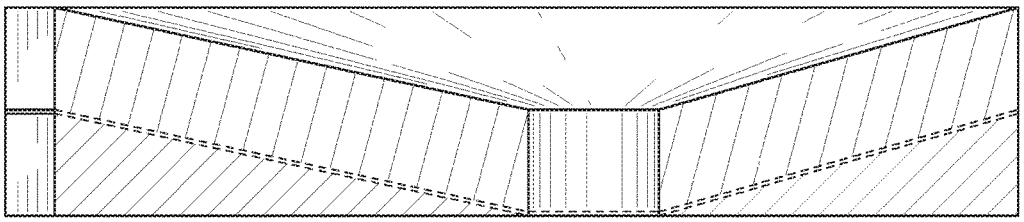
FIG. 65 shows a cross-sectional view of FIG. 64, where a waterproofing liner shown as dashed lines is disclaimed from the design.
Figure 66:
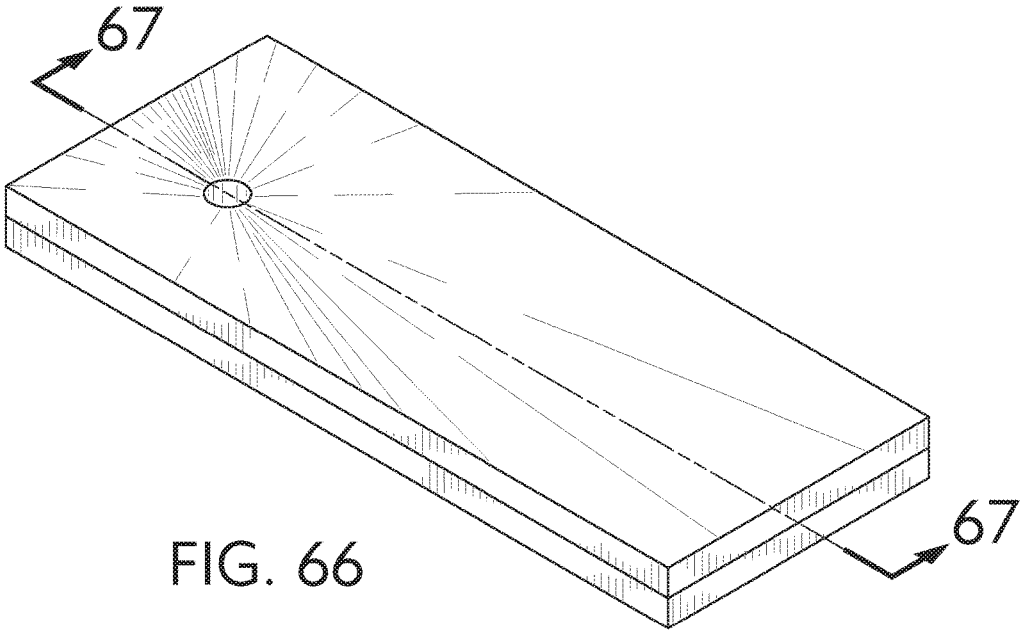
Figure 67:
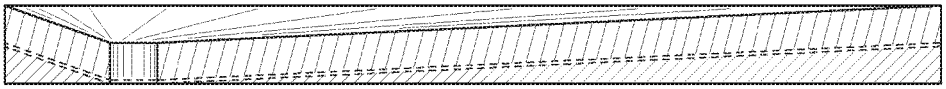
FIG. 67 shows a cross-sectional view of FIG. 66, where a waterproofing liner shown as dashed lines is disclaimed from the design.

FIG. 53 shows a perspective view of a ninth embodiment of a floor pan. FIG. 54 shows a lengthwise cross-sectional view of FIG. 53 while FIG. 55 shows a width-wise cross-sectional view of FIG. 53. FIG. 56 shows a top of the pan of FIG. 53, while FIG. 57 shows a bottom view of the pan of FIG. 53. FIG. 58 shows a front/back view of the pan of FIG. 53, while FIG. 59 shows a side view of the pan.

A shower pan and a method of using same are disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A shower pan, comprising:

a first preformed portion having a drain hole and a bottom flat surface to contact a floor and a top surface having a predetermined slope toward the drain hole; and a non-compressible second preformed portion coupled to the first portion at the drain hole, the second portion having a bottom surface with the predetermined slope to gaplessly fit with the first portion through a waterproofing pan liner, wherein tiles are subsequently mounted on the non-compressible second portion.

2. The pan of claim 1, wherein the top of the second portion is sloped to the drain hole as an upside down cone shape or an angled surface.

3. The pan of claim 1, wherein the slope comprises at least 0.25 inch declination per foot.

4. The pan of claim 1, wherein edges of the top surface of the first and second portions form parallel lines with respect to the bottom edges.

5. The pan of claim 1, wherein the first and second portions comprise a rectangular, square, sector, or quadrangle shape.

6. The pan of claim 1, wherein the drain hole comprises a rectangular, square, sector, or quadrangle shape.

7. The pan of claim 1, wherein the drain hole is central to the pan.

8. The pan of claim 1, wherein the pan has two sides and the drain hole is non-symmetrically placed on one side of the pan.

9. The pan of claim 1, wherein the pan liner is positioned between the first and second portions.

10. The pan of claim 1, comprising a drain and locking ring or bolt to secure the drain to the liner and a pipe coupled to the drain hole.

11. A method for building a shower, comprising:

forming a shower subfloor with a flat surface to support a first preformed pan module;

placing the first preformed pan module with a first flat surface facing the subfloor flat surface, the first preformed pan module having a first sloped surface toward a drain hole;

placing a non-compressible second preformed pan module above the first preformed pan module with a shower pan liner in between for waterproofing, the second preformed module having a first surface to engage the first sloped surface with the liner and an upper sloped surface; and installing tiles on the upper sloped surface of the second preformed pan module.

12. The method of claim 11, wherein the top of the second portion is sloped to the drain hole as an upside down cone shape or an angled surface.

13. The method of claim 11, wherein the slope comprises 0.25 inch declination or more per foot.

14. The method of claim 11, wherein edges of the top surface of the first and second portions form parallel lines with respect to the bottom edges.

15. The method of claim 11, wherein the first and second portions comprise a rectangular, square, sector, or quadrangle shape.

16. The method of claim 11, wherein the drain hole comprises a rectangular, square, sector, or quadrangle shape.

17. The method of claim 11, wherein the drain hole is central to the pan.

18. The method of claim 11, wherein the pan has two sides and the drain hole is non-symmetrically placed on one side of the pan.

19. The method of claim 11, comprising a drain and locking ring or bolt to secure the drain to the liner and a pipe coupled to the drain hole.

20. A shower system, comprising:

a first preformed portion having a drain hole and a bottom flat surface to contact a floor and a top surface having a predetermined slope toward the drain hole;

a non-compressible second preformed portion coupled to the first portion at the drain hole, the second portion having a bottom surface with the predetermined slope to gaplessly fit with the first portion through a waterproofing pan liner; and tiles installed above the second portion.

* * * * *